US008413351B1

(12) United States Patent
Watters et al.

(10) Patent No.: US 8,413,351 B1
(45) Date of Patent: Apr. 9, 2013

(54) SHOE SYSTEM WITH REMOVABLE COVERS

(76) Inventors: Megan W. Watters, Knoxville, TN (US); Johnathan C. Prewitt, Knoxville, TN (US); Aaron Fain, Blountville, TN (US); Valerie Acquisto, Blountville, TN (US)

( * ) Notice: Subject to any disclaimer, the term of this patent is extended or adjusted under 35 U.S.C. 154(b) by 325 days.

(21) Appl. No.: 12/792,554

(22) Filed: Jun. 2, 2010

(51) Int. Cl.
*A43B 3/24* (2006.01)

(52) U.S. Cl. ..... 36/101; 36/7.1 R; 36/100

(58) Field of Classification Search ..... 36/7.1 R, 36/72 R, 100, 101, 136
See application file for complete search history.

(56) References Cited

U.S. PATENT DOCUMENTS

| | | | | |
|---|---|---|---|---|
| 2,200,080 | A | 5/1940 | Fein | |
| 2,236,367 | A * | 3/1941 | Gruber | 36/101 |
| 2,519,108 | A | 8/1950 | Bryant et al. | |
| 2,552,943 | A | 5/1951 | Danielius | |
| 3,154,866 | A | 11/1964 | Laufbahn | |
| 3,890,725 | A | 6/1975 | Lea et al. | |
| 4,461,102 | A | 7/1984 | DeVincentis | |
| 4,887,369 | A | 12/1989 | Bailey et al. | |
| 5,144,759 | A * | 9/1992 | Mascotte | 36/7.1 R |
| 5,544,430 | A * | 8/1996 | Jacko | 36/7.1 R |
| D384,495 | S | 10/1997 | Watson | |
| 5,778,564 | A * | 7/1998 | Kettner | 36/101 |
| 7,171,768 | B2 | 2/2007 | Klein | |
| 7,219,445 | B2 | 5/2007 | Stern et al. | |
| 8,015,731 | B2 * | 9/2011 | Jackson | 36/101 |
| 2003/0177664 | A1 * | 9/2003 | Monassebian | 36/100 |
| 2005/0268496 | A1 * | 12/2005 | Bruce et al. | 36/101 |
| 2006/0032084 | A1 * | 2/2006 | Pang et al. | 36/7.108 |
| 2008/0229615 | A1 * | 9/2008 | Yu | 36/100 |
| 2010/0122474 | A1 * | 5/2010 | Wolf et al. | 36/101 |

* cited by examiner

*Primary Examiner* — Khoa Huynh
*Assistant Examiner* — Sharon M Prange

(57) ABSTRACT

A shoe system featuring a base shoe in any size, style, or, shape, and a skin for wrapping around the base shoe. The skin may be constructed in a variety of styles, colors, materials, and designs for versatility. The skin attaches via a magnet system an in some embodiments, a notch is disposed on the tip of the skin. In some embodiments, tabs are disposed on the skin for inserting into seam notches in the back of the base shoe.

3 Claims, 6 Drawing Sheets

SHOE SYSTEM WITH REMOVABLE COVERS

FIELD OF THE INVENTION

The present invention is directed to shoes, more particularly to shoes that allow for removing and replacing the outer cover to increase versatility of the shoes.

BACKGROUND OF THE INVENTION

Purchasing many pairs of shoes can be extremely costly and require the individual to have a sizable closest for storage and/or displaying purposes. Travelers are either forced to leave many shoes behind or carry large pieces of luggage with them. The present invention features a shoe system with removable covers. The removable covers can be designed in any style, design, or color, and allow a user to create various different shoes with a single base shoe.

The shoe system of the present invention ("changeable shoes") utilizes a magnetic locking system. The attachments for shoes (e.g., "skins") wrap around the exterior of the base shoe using high power magnets to adhere. The appropriate locking system for the highest magnetic quality may depend on the manufacturer's preference. The shoe system may be available in any shoe style including flip flops, clogs, boots, men's styles, women's styles, children's styles, casual styles, and dress styles. The shoe system may also include athletic wear, for example allowing for changing of colors or designs on sports teams shoes. The concept of the shoe system is to change any pair of shoes by attaching the "skin" (e.g., magnetic attachment). In some embodiments, the locking system is placed accordingly around all sides of the shoe and will adhere down the back seam. Small magnets may be used so they will be hidden along the shoe. To begin the attachment process, a user may utilize a small notch at the top of the shoe to interlock the starting point, and from there the user can wrap the attachment easily via the magnets.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
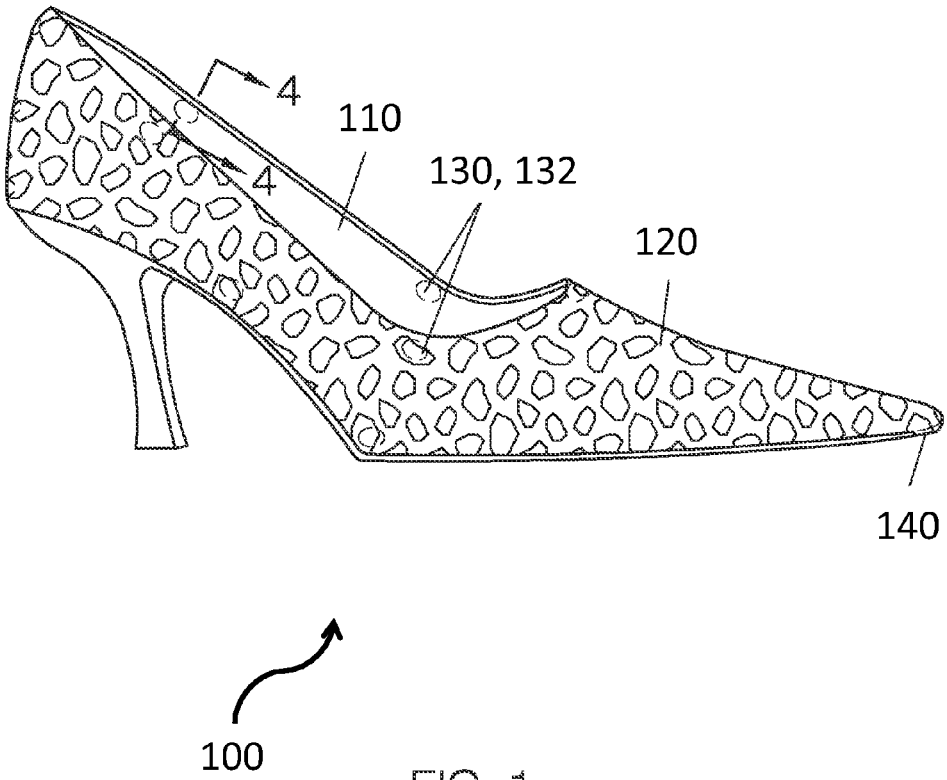
FIG. 1 is a first perspective view of the shoe system of the present invention.

Referring now to FIGS. 1-8, the present invention features a shoe system 100 including removable covers for a base shoe 110. The shoe system 100 can help increase the versatility of a pair of shoes.

The shoe system 100 of the present invention comprises a base shoe 110 that resembles a standard shoe, which is well known to one of ordinary skill in the art. The base shoe 110 may be constructed in a variety of styles and shapes and sizes. For example, in some embodiments, the base shoe 110 resembles a pump (e.g., with a heel 108), a flat, a flip flop, a clog, a man's shoe, a woman's shoe, a child's shoe, a casual shoe, an athletic shoe, a dress show, etc. The base shoe 110 is not limited to these examples. Like standard shoes, the base shoe 110 has a front edge 101 (e.g., pointed, rounded, etc.), a back edge 102 (e.g., a back seam), a first side, a second side, a toe-covering portion 105, a sole, and a foot opening. The shoe comprises a heel 150 and an upper portion 155 above the heel.

Figure 2:
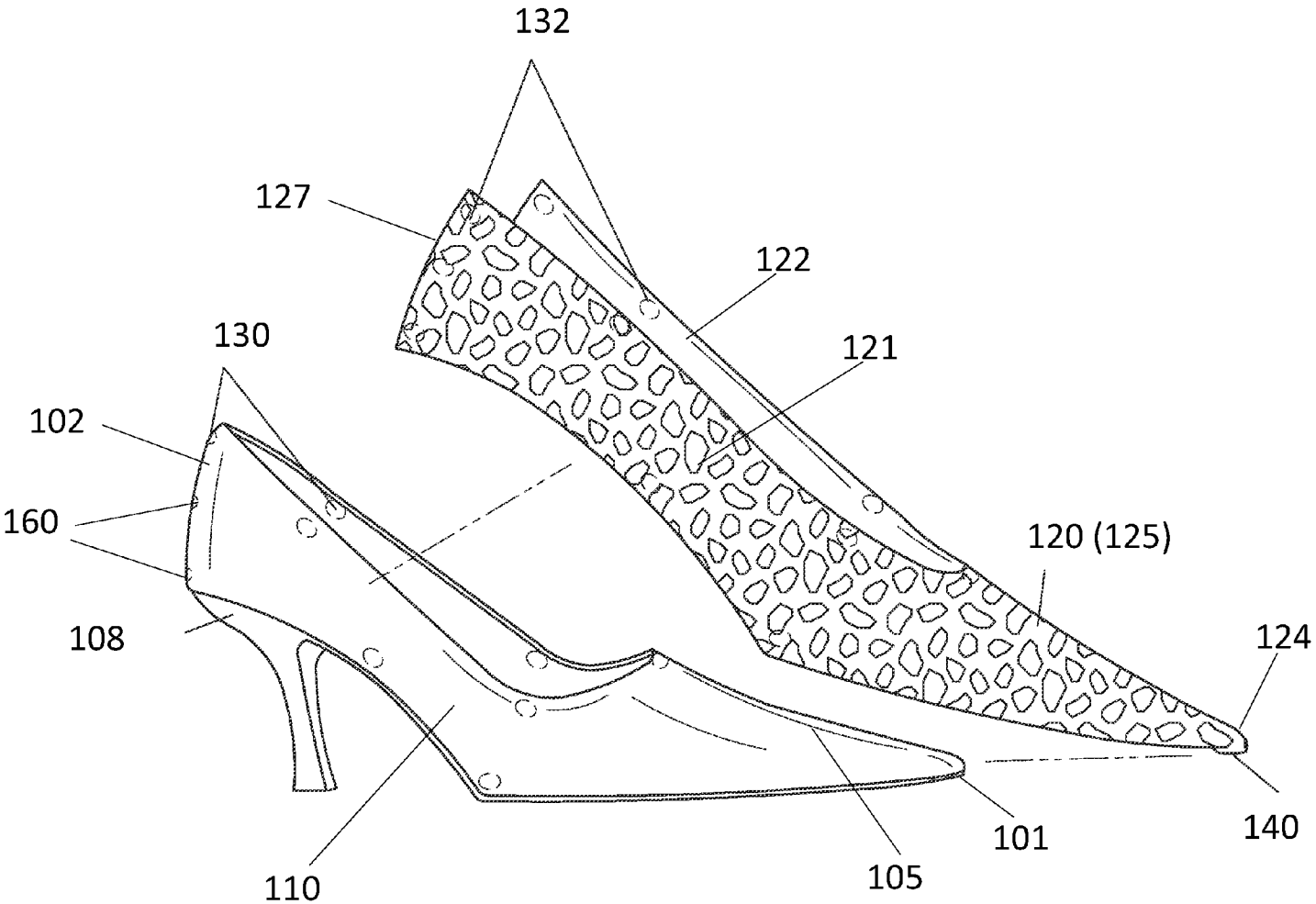
FIG. 2 is a second perspective view of the shoe system of FIG. 1, wherein the skin is removed.
Figure 3:
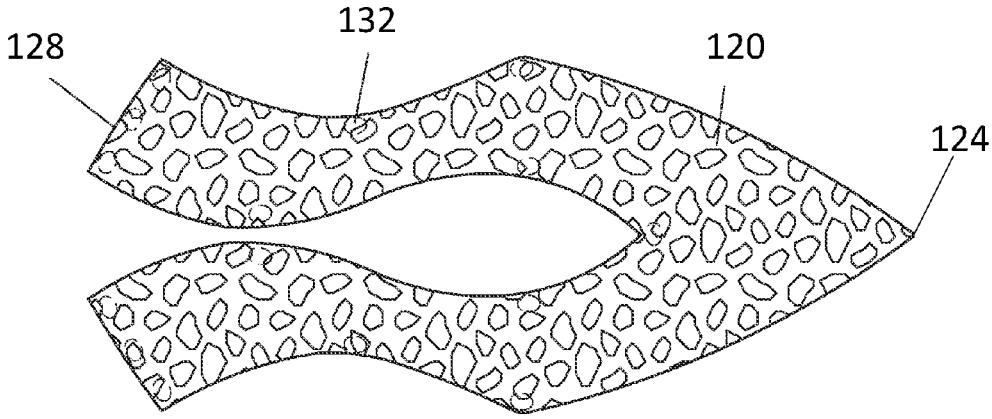
FIG. 3 is a top view of a skin of the shoe system of FIG. 1.
Figure 4:
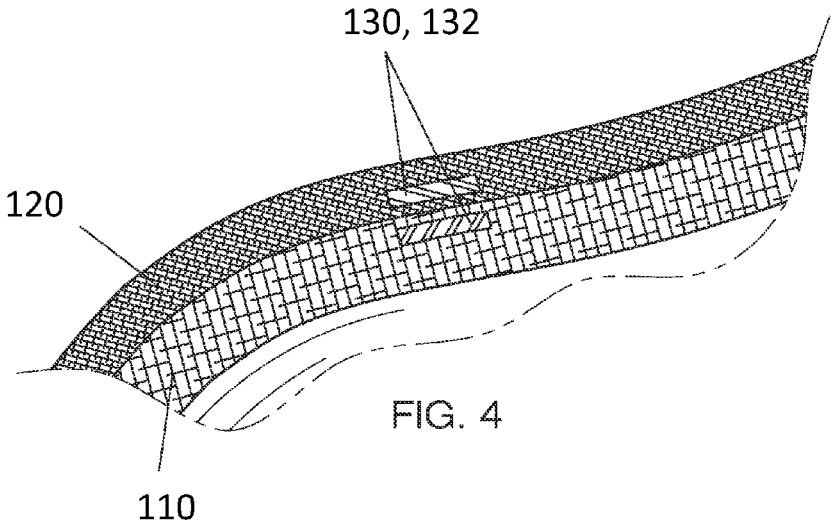
FIG. 4 is a cross sectional view of the shoe system of FIG. 1.

As shown in FIG. 1 and FIG. 2, a skin 120 can be removably attached to the base shoe 110 (e.g., via magnets) to create a differently designed and/or colored shoe. For example, the skin 120 may be constructed from a material comprising leather, suede, plastic, textiles/fabrics, the like, or a combination thereof. The skin 120 comprises a toe 124, a top portion 125, a first side 121, and a second side 122 (the sides extend downwardly from the toe 124 and top portion 125 (see FIG. 2, FIG. 3). For example, FIG. 3 shows the toe 124 being the end of the top portion 125 of the skin 120 and the sides 121, 122 extending away from the top portion 125. The back edge 127 of the first side 121 and the back edge 128 of the second side 122 are generally free (e.g., the edges 127, 128 are not necessarily connected) (see FIG. 2, FIG. 3). When the skin 120 is place over the base shoe 110, the toe 124 covers the front edge 101 of the base shoe 110, the top portion 125 covers the toe-covering portion 105 of the base shoe 110, and the sides 121, 122 cover the sides of the base shoe 110 (see FIG. 6).

Figure 5:
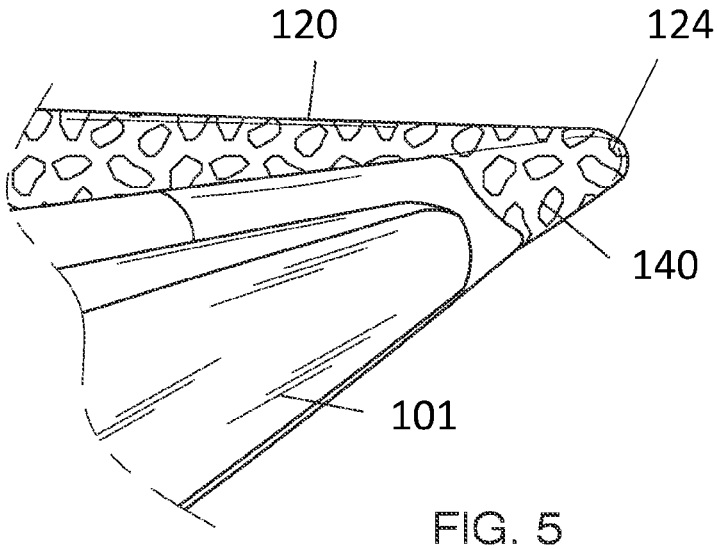
FIG. 5 is a detailed view of the front edge of the base shoe of the system of FIG. 1
Figure 6:
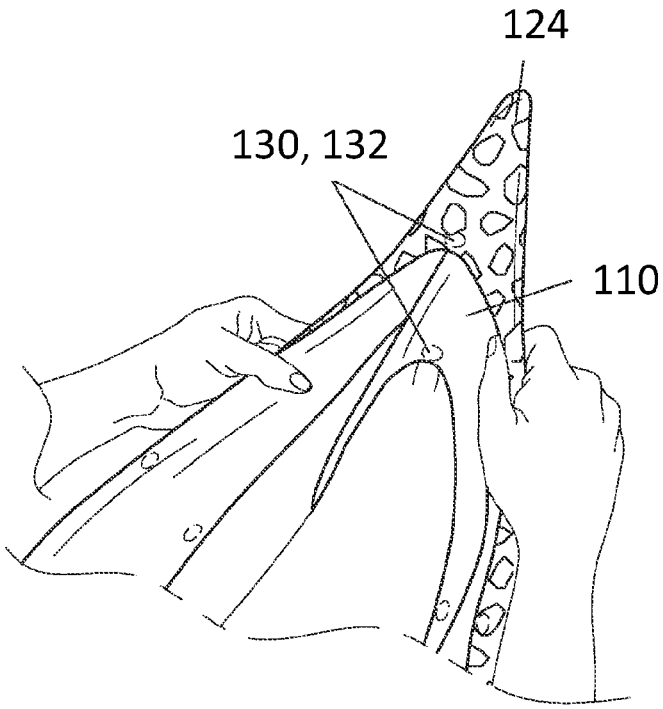
FIG. 6 is an in-use view of the shoe system of FIG. 1, wherein a user is attaching a skin to the base shoe.
Figure 7:
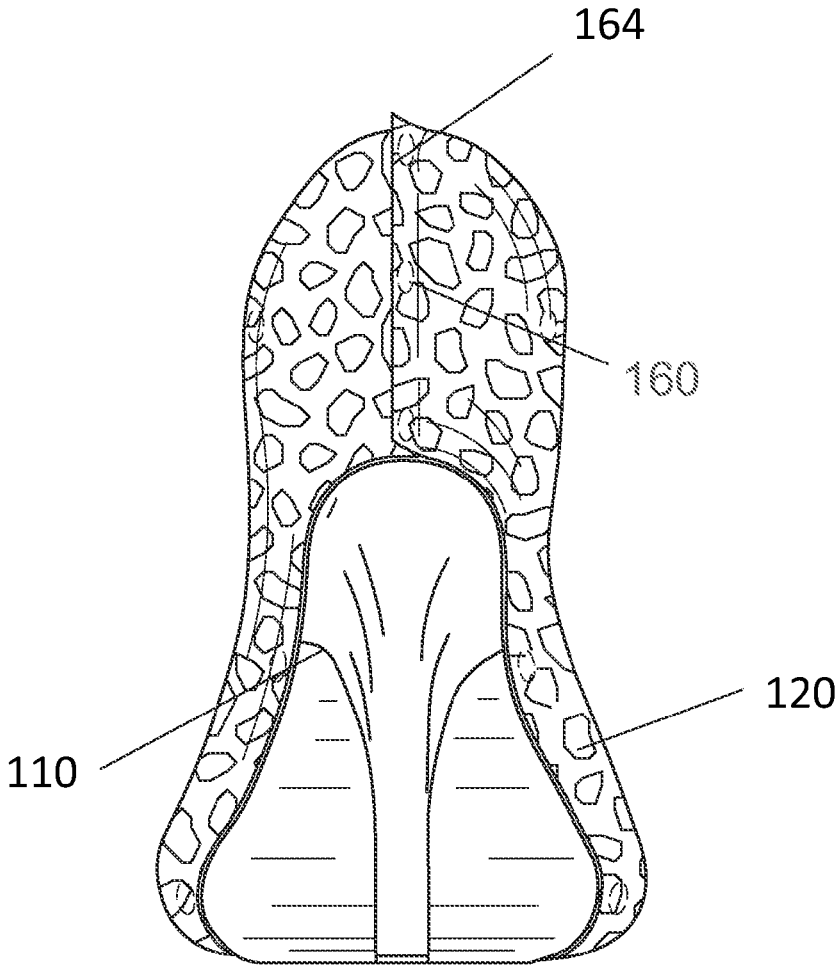
FIG. 7 is a back view of the shoe system of FIG. 1.

As shown in FIG. 5, a notch 140 is disposed on the underside of the toe 124 of the skin 120, which functions to engage and snugly fit around the front edge 101 of the base shoe 110. The notch 140 helps hold the skin 120 in place.

A plurality of first half magnets 130 is disposed in the base shoe 110, and a plurality of second half magnets 132 disposed in the skin 120. The first half magnets 130 are adapted to engage the second half magnets 132 to help hold the skin 120 in place on the base shoe 110. The magnets 130, 132 are arranged appropriately such that when the skin 120 is placed over the base shoe 110 in the correct position the magnets 130, 132 align with each other (see FIG. 4).

Figure 8:
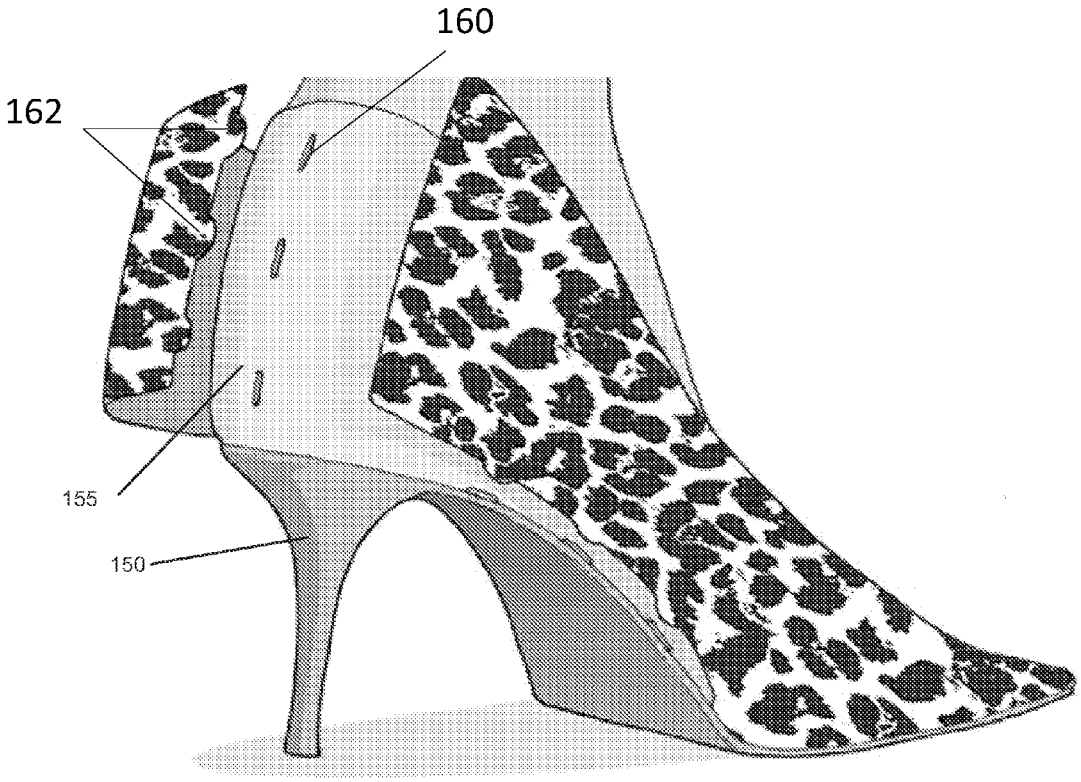
FIG. 8 is a back perspective view of the shoe system of FIG. 1.

In some embodiments, seam notches 160 are disposed in the back 102 of the base shoe 110 and tabs 162 are disposed on the back edge 127 of the first side 121 of the skin 120 (or on the back edge 128 of the second side 122 of the skin 120), wherein the seam notches 160 are adapted to receive the tabs 162 (see FIG. 8). The tabs 162 may help further secures the skin 120 in place on the base shoe 110. In some embodiments, a seam attachment means 164 is disposed in the back edge 127 of the first side 121 of the skin 120 and/or on the back edge 128 of the second side 122 of the skin 120 for securing the back edges 127, 128 together (e.g., when wrapped around the base shoe 110, see FIG. 7).

The following the disclosures of the following U.S. patents are incorporated in their entirety by reference herein: U.S. Pat. No. 7,219,445; U.S. Pat. No. 4,461,102; U.S. Pat. No. 3,154,866; U.S. Pat. No. 2,552,943; U.S. Pat. No. 2,519,108; U.S. Pat. No. 2,200,080; U.S. Pat. No. 3,890,725; U.S. Pat. No. 4,887,369; U.S. Pat. No. 7,171,768.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A shoe system comprising:

(a) a base shoe having a front edge, a back edge, a first side, and a second side, wherein the shoe comprises a heel and an upper portion above the heel;

(b) a skin comprising a toe, a first side and a second side that each extend away from the toe, the first side and second side each have a free back edge, and a notch disposed underneath the toe, wherein the skin is adapted to be removably wrapped around the base shoe such that the toe of the skin covers the front edge of the base shoe, the sides of the skin cover the sides of the base shoe, and the notch snugly fits around the front edge of the base shoe;

(c) a plurality of first half magnets disposed in the base shoe;

(d) a plurality of second half magnets disposed in the skin, the first half magnets are adapted to engage the second half magnets, wherein the first half magnets and second half magnets are arranged such that when the skin is appropriately placed over the base shoe the magnets align with each other;

(e) a plurality of tabs disposed on either the back edge of the first side of the skin or on the back edge of the second side of the skin;

(f) a plurality of seam notches disposed on the upper portion of the base shoe, wherein the notches are aligned vertically, wherein the seam notches are adapted to snugly receive the tabs; and (g) a seam attachment means disposed on either the back edge of the first side of the skin or on the back edge of the second side of the skin, the seam attachment means functions to secure the back edges of the first side and second side of the skin together when the skin is wrapped around the base shoe.

2. The shoe system of claim 1, wherein the skin is constructed from a material comprising leather, suede, plastic, textile, fabrics, or a combination thereof.

3. A shoe system consisting of:

(a) a base shoe having a front edge, a back edge, a first side, and a second side, wherein the shoe comprises a heel and an upper portion above the heel;

(b) a skin comprising a toe, a first side and a second side that each extend away from the toe, the first side and second side each have a free back edge, and a notch disposed underneath the toe, wherein the skin is adapted to be removably wrapped around the base shoe such that the toe of the skin covers the front edge of the base shoe, the sides of the skin cover the sides of the base shoe, and the notch snugly fits around the front edge of the base shoe;

(c) a plurality of first half magnets disposed in the base shoe;

(d) a plurality of second half magnets disposed in the skin, the first half magnets are adapted to engage the second half magnets, wherein the first half magnets and second half magnets are arranged such that when the skin is appropriately placed over the base shoe the magnets align with each other;

(e) a plurality of tabs disposed on either the back edge of the first side of the skin or on the back edge of the second side of the skin;

(f) a plurality of seam notches disposed on the upper portion of the base shoe, wherein the notches are aligned vertically, wherein the seam notches are adapted to snugly receive the tabs; and (g) a seam attachment means disposed on either the back edge of the first side of the skin or on the back edge of the second side of the skin, the seam attachment means functions to secure the back edges of the first side and second side of the skin together when the skin is wrapped around the base shoe.

* * * * *